United States Patent [19]

Brooks

[11] 4,040,541

[45] Aug. 9, 1977

[54] HINGED CLOSURE FOR A BATTERY-OPERATED CIGARETTE LIGHTER

[75] Inventor: Donald Leslie William Brooks, Ashtead, England

[73] Assignee: Ronson Corporation, Woodbridge, N.J.

[21] Appl. No.: 726,188

[22] Filed: Sept. 24, 1976

[30] Foreign Application Priority Data

Sept. 30, 1975 United Kingdom ..... 40042/75

[51] Int. Cl.[2] ..... B65D 43/14; B65D 51/04

[52] U.S. Cl. ..... 220/339; 431/152; 141/350; 219/268; 220/334

[58] Field of Search ..... 220/334, 339; 431/152, 431/146; 141/350; 219/267, 268

[56] References Cited

U.S. PATENT DOCUMENTS

| | | | |
|---|---|---|---|
| 3,685,684 | 8/1972 | Schindler et al. | 220/334 |
| 3,899,285 | 8/1975 | Christmas | 431/152 |

*Primary Examiner*—George T. Hall

*Attorney, Agent, or Firm*—Toren, McGeady and Stanger

[57] ABSTRACT

A cover, removably mounted in a recess at one end of a cigarette lighter body, permits access to lighter service points within the recess. The cover includes an integral member formed of a plastics material and having a plate-like body consisting of a first section hinged to a second section by a reduced thickness section of the body. Projections extend from the first section of the body for releasably holding it within the recess. A hollow cylindrical spigot extends from the second section and is secured into the recess by a bayonet-like connection. By lifting the first section out of the recess it can be displaced angularly about its hinged connection to the second section and access can be obtained to the part of the recess covered by the first section. If necessary, the second section can be removed by twisting the plate-like body to open the bayonet-like connection with the lighter body. A spring is fitted into the spigot on the second section for biasing a lighter part, such as a battery, to the lighter.

13 Claims, 3 Drawing Figures

HINGED CLOSURE FOR A BATTERY-OPERATED CIGARETTE LIGHTER

This invention relates to battery operated cigarette lighters and in particular to a cover for closing recesses formed in the body of the lighter.

Cigarette lighters, whether they be fuelled by liquefied gas or normally liquid fuels, have various adjustment means or service points such as flame height regulators, filling valves or refuelling apertures. These can be unsightly and are usually housed in a recess or aperture in the lighter body which is provided with a cover. In one form the cover consists of a plug which is retained in position by friction or by means of a screw thread. Both types involve the risk of loss of a small component — the plug — and in the case of a screw threaded. plug a tool may be necessary for its fitment and removal. Among the more expensive methods of concealing adjustment means and service points in lighters the cover consists of a metal flap which is hinged to the body of the lighter.

Furthermore, certain types of electronic lighters require to be powered by a small battery which is contained within the lighter body. Such batteries may be inserted by partially dismantling the casing of the lighter or may be introduced into the lighter body through an aperture. This battery aperture also requires a cover which, with certain types of battery, may further require to effect some form of electrical connection between the battery and the electronic circuitry within the lighter.

According to the present invention there is provided a cover for a recess or aperture containing adjustment means or service points in a battery-operated cigarette lighter, the cover comprising an integral body formed of plastics material, such as polypropylene, and having a first portion which constitutes a flap, a second portion connected to the first portion by means of a region of reduced thickness such that the first and second portions are hinged with respect to each other and together form a cover for the recess or aperture, means associated with the second portion for releasably securing the second portion to the lighter, and electrically conductive spring means associated with the second portion for retaining the battery in place and providing an electrical connection therefor.

In use of the cover, the region of reduced thickness serves to enable the first portion of the integral body to be swung open to expose the recess or aperture normally concealed thereby. Preferably the lighter body is formed with a shallow recess into which the cover fits.

The securing means may comprise an upstanding spigot which is designed to fit into the battery access aperture and be removably secured therein, for example by means of an exterior rib on the spigot which latches behind the lighter body. In an alternative embodiment, the exterior surface of the spigot is provided with oppositely disposed pegs which slide into an angled groove in the interior walls of the battery access aperture to form a conventional bayonet fitting.

The spring means may comprise any form of metal spring, and will generally be attached to the spigot so that, when the spigot is inserted, the spring biasses itself against the base of the battery, thus securing the battery in place and establishing an electrical connection with the base of the battery. The spring may be a leaf spring or a coil spring.

In a preferred embodiment of the invention, the securing means and the spring means are combined together and comprise a hollow upstanding spigot whose outside dimensions are such that it will fit loosely in the battery access aperture. A strip of conductive material extends across the interior of the spigot and passes through oppositely disposed apertures in the wall of the spigot such that each end projects slightly beyond the exterior surface of the spigot. A coil spring is loosely secured in the interior of the spigot and extends therefrom to act between the bottom of the battery and the conductive strip. The projecting ends of the strip cooperate with a groove in the wall of the battery access aperture to provide a bayonet locking device and also to provide one of the battery connections. For this latter purpose the lighter body itself may be of metal, thus providing the common (earth) connection of the electronic circuit. Alternatively suitable contacts may be positioned to engage the ends of the strip when the cover is in position.

In order that the invention may be better understood, an embodiment thereof will now be described by way of example only and with reference to the accompanying drawings in which.

Figure 1:
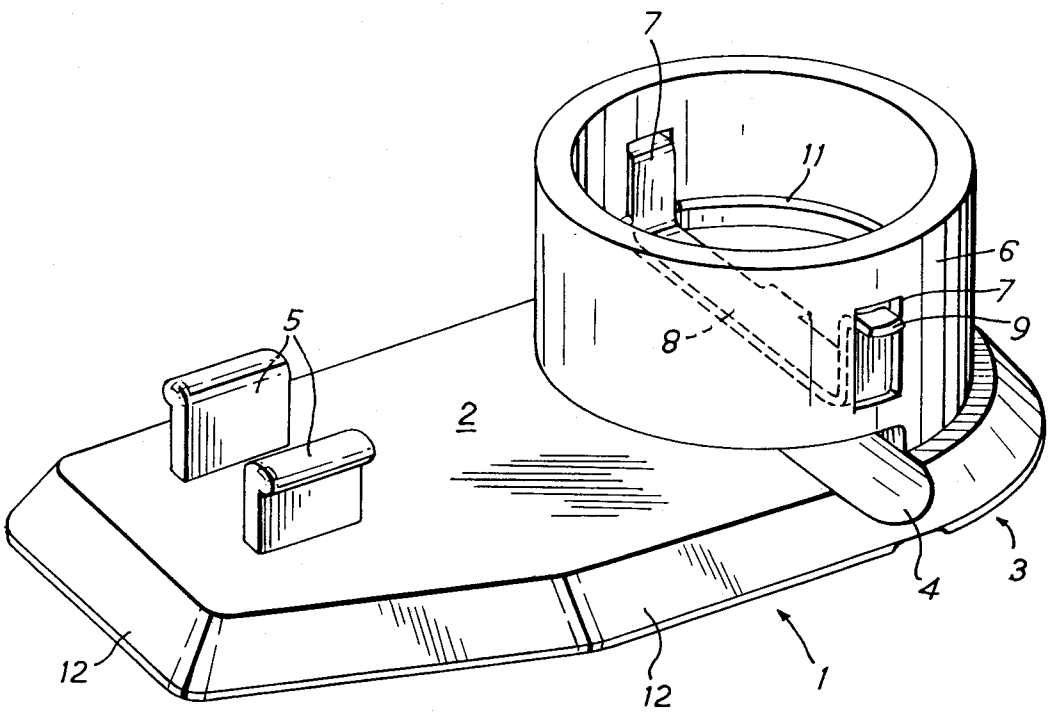
FIG. 1 is a perspective view of one embodiment of a cover for the filling valve recess of a battery operated cigarette lighter.

Referring to the drawings, the cover comprises and integral body 1 of polypropylene which is divided into two portions 2, 3 separated by a line 4 of reduced thickness. The line 4 enables the portions 2 and 3 to be hinged with respect to one another. The portion 2 is provided with a pair of upstanding limbs 5, also of polypropylene, which extend into the recess or aperture to be closed. The free end of each limb is enlarged as shown to form a hook which latches into a groove or behind a suitable shoulder in the lighter body, thus enabling the portion 2 to be latched in the closed position.

The portion 3 is equipped with an upstanding hollow spigot 6 which, in use, is inserted into the battery aperture. The wall of the spigot 6 is provided with two oppositely disposed rectangular apertures 7 through which extends a metal strip 8. The strip 8 is bent in the form of a flat-bottom U, and the free ends of the arms of the U are bent outwards to form a pair of tabs 9 which project from the exterior surface of the spigots. The tabs 9 act with a co-operating ridge (to be described later) in the body of the lighter to provide a conventional bayonet action.

A coil spring 10, tapered in an upwards direction, is seated within the spigot 6 in electrical contact with the strip 8. The spring 10 is not shown in FIG. 1 for the sake of clarity. The spring is securely located behind an annular ridge 11 which extends around the interior of the spigot 6.

The edge of the body 1 is formed with a slight chamfer, as shown under reference 12, which enables the cover to be lifted by means of a finger nail or thin implement.

Figure 2:
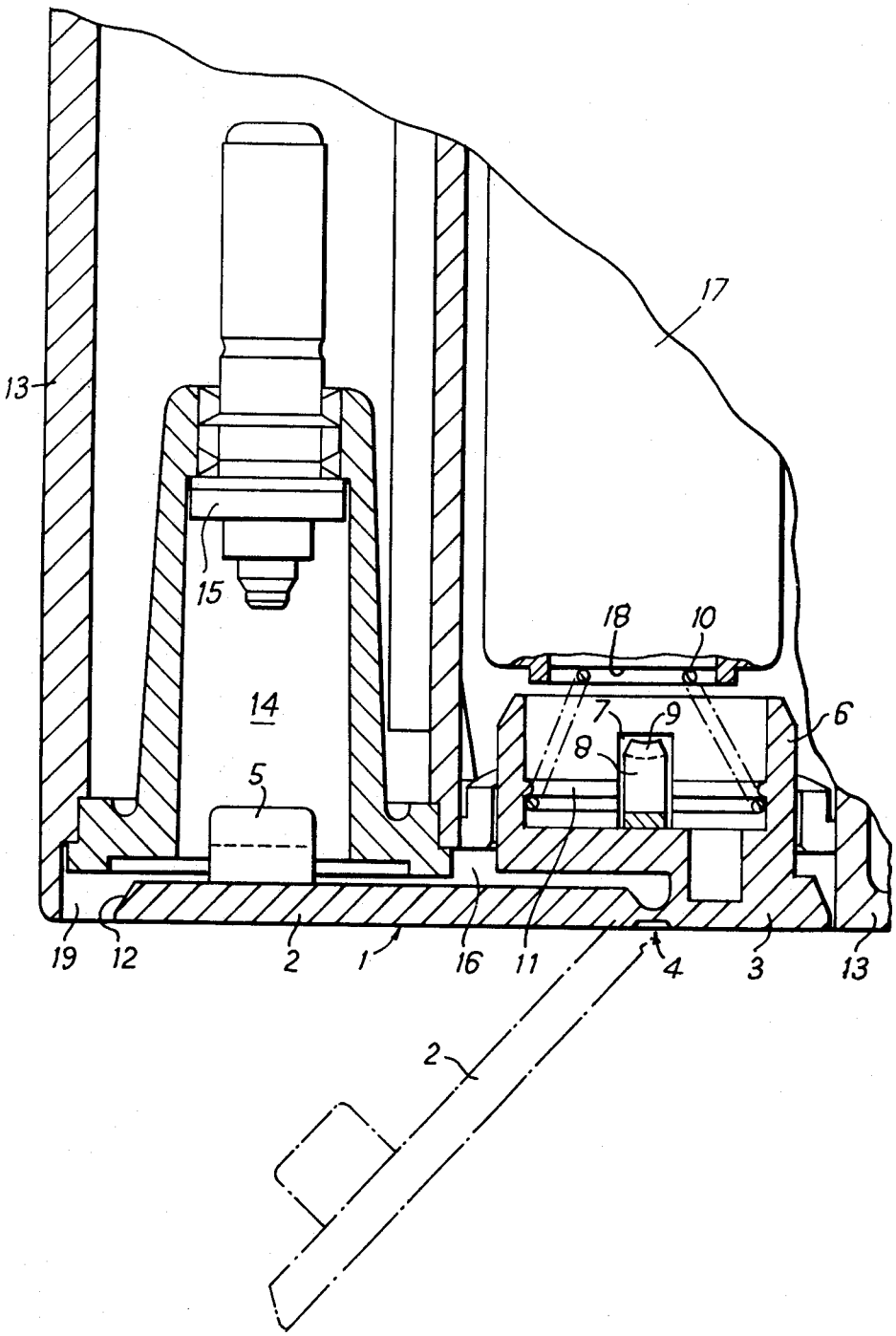
FIG. 2 is a sectional side view of the cover of FIG. 1 installed in a lighter, shown partly broken away.

Referring now particularly to FIG. 2, there is shown the cover of FIG. 1 fitted into a battery operated lighter. Only those parts of the lighter which are necessary for an understanding of the present invention are illustrated. The lighter comprises a body 13 in which is formed a recess 14 for the fuel inlet valve 15 and an access aperture 16 for the battery 17. The lower electrical terminal 18 of the battery is to be grounded to the case or to other internal circuitry. The above described cover serves the dual purpose of covering both the recess 14 and aperture 16, as well as grounding the terminal 18 of the battery. The closed position of the cover is shown in full lines, while the open position (i.e. hinged about the line 4) is shown in dotted lines. In its closed position the portion 2 of the cover is latched in place by means of the limbs 5 which engage in the recess 14.

A space 19 is left between the free edge of the portion 2 and the body 13 of the lighter in order to enable a user to insert his finger nail under the chamfered edge to open the cover for refueling of the lighter. In the event that the battery needs replacement, the portion 2 is lifted until it is substantially at right angles to the bottom of the lighter. The portion 2 is then gripped between the fingers and pushed inwards against the bias of spring 10 whilst simultaneously twisting the portion 2 to release the bayonet locking device. The portion 2 can thence be withdrawn leaving the battery aperture open. It will be noticed that the line 4, about which the portions 2 and 3 hinge, passes through the axis of the spigot 6 so that the structure is balanced for easy release of the bayonet locking device.

Figure 3:
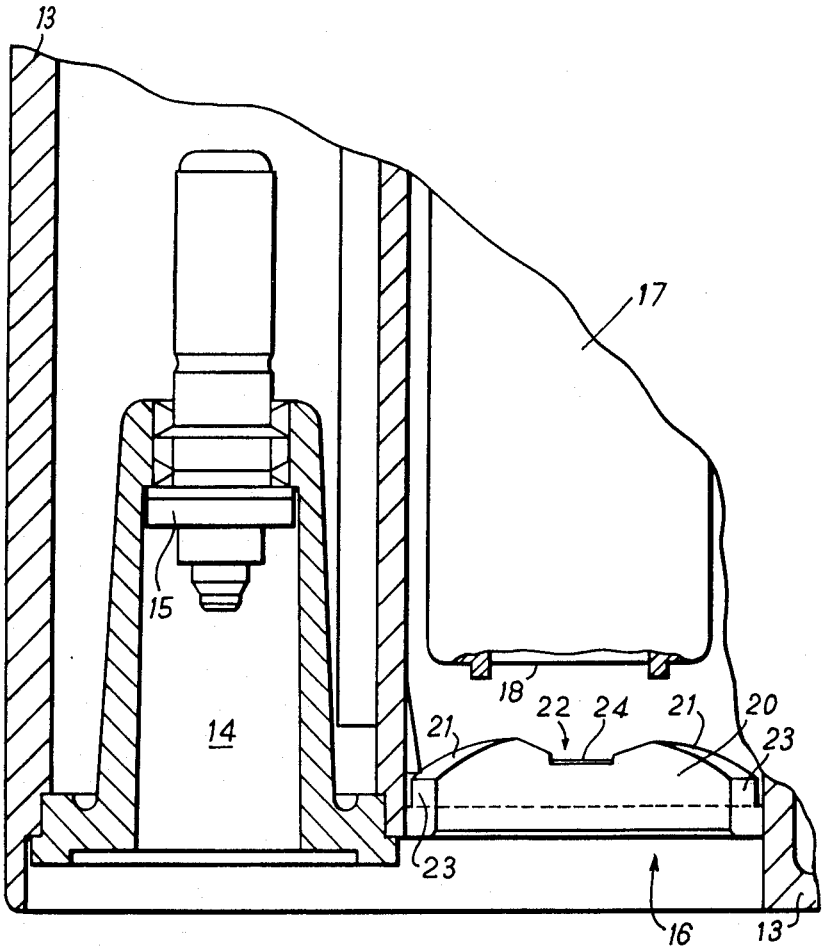
FIG. 3 is a view similar to FIG. 2, with the cover removed.

FIG. 3 is similar to FIG. 2, but with the cover removed enabling details of the bayonet locking device to be seen. The locking device comprises two half annular ridges 20, each extending through just less than 180° around the edge of the battery access aperture 16. In FIG. 3, one only of the ridges 20 can be seen, but the full extent of the ridge is visible. Each ridge 20 comprises a pair of sloping surfaces 21 joined by a lower central portion 22. The other end of each sloping surface 21 terminates abruptly in a wall 23. The two ridges 20 are dimensioned so that a small gap remains between the wall 23 of one ridge and that of the corresponding wall of the other ridge. Thus two gaps are present, each having a width sufficient to receive a respective tab 9.

In use, the cover is fitted by first introducing the portion 3 of the cover into the aperture 16 such that the tabs 9 enter the gap between the ridges 20. The portion 3 is thence twisted through 90° so that the tabs 9 ride up a respective sloping surface 21 and fall into the central portion 22 under the bias of spring 10. The central portion 22 of one or both ridges 20 is provided with a respective electrical contact element 24 which contacts the tab 9 and thus completes the necessary connection between the terminal 18 of the battery and the circuitry (not shown) within the lighter.

There has thus been described a cover which, in a single unit, is able to conceal both the battery aperture and the fuel inlet aperture of a cigarette lighter. The cover can be opened to reveal the fuel inlet aperture only, without effecting the concealment of the battery aperture or it can be removed entirely to enable battery replacement to be effected.

What we claim is:

1. A cover for a recess in a battery-operated cigarette lighter, said cover comprising an integral body formed of plastics material, said body comprising a plate-like closure section for the recess and said closure section having a first portion which constitutes a flap movable between a closed position and an open position, a second portion connected to the first portion by means of a region of reduced thickness such that the first and second portions are hinged with respect to each other and together form the closure section for the recess, means associated with said second portion for releasably securing the second portion within the recess in the lighter, and electrically conductive spring means associated with said second portion for retaining a part in place within the lighter and for providing an electrical connection therefor.

2. A cover as claimed in claim 1 wherein the first portion having a first surface arranged to face inwardly into the recess and having at least one upstanding projection, said at least one projection, in the closed position of the flap, being operable to secure the first portion in the recess to thereby maintain the flap in the closed position.

3. A cover as claimed in claim 1 wherein the second portion having a first surface arranged to face inwardly into the recess, the securing means comprises an upstanding spigot formed integrally with and extending from the first surface on the second portion for insertion into the recess of the cigarette lighter.

4. A cover as claimed in claim 3 wherein the spring means comprises a metal spring which is attached to the spigot so that, when the spigot is inserted in the recess of the lighter, the spring is arranged for biasing the part into the lighter.

5. A cover as claimed in claim 4 wherein the spigot is hollow, and the spring is located at least partly within the hollow interior of the spigot.

6. A cover as claimed in claim 5 wherein the spring is a leaf spring.

7. A cover as claimed in claim 5 wherein the spring is a coil spring.

8. A cover as claimed in claim 7 wherein the hollow spigot is of generally cylindrical form having a circular inside wall surface and a circular outside wall surface, and the coil spring is positioned so that its major axis lies along the major axis of the spigot.

9. A cover as claimed in claim 8 wherein the spigot is formed with an outstanding ridge extending circumferentially around and extending inwardly from the circular inside wall surface thereof, and at least one turn of the spring is located behind the ridge in order to locate the spring in position in the spigot.

10. A cover as claimed in claim 5 wherein oppositely disposed pegs extend outwardly from the outside wall surface of the spigot which co-operate with a suitably shaped surface of the recess to form a bayonet-locking device for releasably securing the spigot within the recess.

11. A cover as claimed in claim 10, the hollow spigot having a pair of oppositely disposed apertures therein, a strip of conductive material located within and extending across the interior of the spigot with the opposite ends of the strip and passing through the oppositely disposed apertures in the wall of the spigot such that each end of the strip projects slightly beyond the outside wall surface of the spigot for forming said pegs.

12. A cover as claimed in claim 11 wherein said spring contacts the strip so that electrical contact is established between the spring and strip.

13. A cover as claimed in claim 10 wherein the region of reduced thickness separating the first and second portions of the body passes through the major axis of the spigot.

* * * * *